United States Patent [19]

Dodge

[11] Patent Number: 4,626,852

[45] Date of Patent: Dec. 2, 1986

[54] BUOY LANTERN SYSTEM

[75] Inventor: Robert J. Dodge, Houston, Tex.

[73] Assignee: Pennwalt Corporation, Philadelphia, Pa.

[21] Appl. No.: 576,062

[22] Filed: Feb. 1, 1984

[51] Int. Cl.[4] ..... G08G 3/00

[52] U.S. Cl. ..... 340/985; 340/331; 136/291; 441/16

[58] Field of Search ..... 340/84, 331, 114 R, 340/985, 931; 136/291; 441/1, 21, 13, 14, 15, 16

[56] References Cited

U.S. PATENT DOCUMENTS

| | | | |
|---|---|---|---|
| 1,303,860 | 5/1919 | Dalen | 441/13 |
| 1,689,623 | 11/1927 | Eskilson | 441/13 |
| 3,253,138 | 5/1966 | Nagel | 441/16 |
| 4,099,282 | 7/1978 | Townsend | 441/16 |
| 4,410,930 | 10/1983 | Yachabach | 362/145 |

FOREIGN PATENT DOCUMENTS

| | | | |
|---|---|---|---|
| 1076176 | 4/1954 | France | 340/931 |

OTHER PUBLICATIONS

N. V. Pul'manov et al., "Operational Tests on Photoelectric Generators for Navigational Beacons;", 1974, pp. 12–15, from Applied Solar Energy, Allerton Press, N.Y.

W. Hakkarinen, "Solar Power on the Nomad Buoy;", IEEE Conference in Engineering in the Ocean Environment, Panama City, Fla., 21–24, Sep. 1970.

*Primary Examiner*—John W. Caldwell, Sr.
*Assistant Examiner*—Ruffin B. Cordell

[57] ABSTRACT

Lantern employs clear lens protective cover around the drum lens and a clear dome over the solar panel mounted above the lens. A heavily damped gimbal supported by the lantern housing mounts the lens, lamp-changer, and flasher above a bank of batteries suspended from the gimbal. The weight of the batteries aids in providing a righting moment to the gimbal when the marine buoy, atop of which the lantern is secured, is tilted or inclined for sustained periods due to current and/or wind. Interior of the lantern is readily accessible by merely pivoting upwardly an annulus supporting the lens cover, solar panel, and dome.

1 Claim, 9 Drawing Figures

BUOY LANTERN SYSTEM

STATEMENT OF THE INVENTION

This invention relates to buoy marine lanterns and more particulary to such lanterns wherein components heretofore discretely disposed are integrated into an unitary device.

BACKGROUND AND SUMMARY OF THE INVENTION

Buoy marine lanterns serve, for example, as navigational aids to provide rugged markers for underwater obstructions and navigational channels. When properly moored, the buoys with lantern will withstand hurricane force winds and seas.

Typically, existing lanterns for marine use are mounted on an uppermost structure of a sea buoy. The lanterns include discrete components such as a flasher or timer, an automatic lampchanger, a daylight control, solar voltaic panel, regulator for the solar charging system and batteries cooperating therewith. The solar panel may be arranged flatwise above the lantern. Alternatively, a pair of opposed solar panels may be disposed below the lantern and outboard thereof. The batteries and regulator are located in a waterproof compartment within the buoy body with a charge regulator, if one is used. These discrete components are connected by means of wiring or electrical cable.

The discrete component system discussed above suffers numerous disadvantages. For example:

When the solar panels are mounted below the lantern, the shadow of the lantern is necessarily cast thereupon. Orientation or automatic movement of the panels to obtain maximum radiation from the sun, is not considered practical. Since one panel may be shaded, it is necessary to double effective panel area to compensate for the resultant reduced output due to the shading. When the solar panel is horizontally disposed above the lantern, the panel is subject to fouling by birds. Regardless of panel location, i.e., below or above the lantern, mounting supports and hardware are needed, and the exposed panels are vulnerable to physical damage when the buoy is serviced by a buoy tender.

The battery compartment must be maintained watertight since it is disposed below the water line. The compartment must also be vented in order to exhaust any hydrogen formed during the battery charge cycle, necessitating vent pipes.

The drum, or fresnel lens, employed in most existing buoy lanterns has it lens prismatic segments directly exposed to the atmosphere. Water or foreign material accumulating on these exposed lens segments reduces their effectiveness.

Separate or discrete components often present a serious service problem. For example, low battery power may indicate a fault within the battery itself, the regulator, the lantern flasher, lampchanger, wiring, or solar panel. Since an inspection and diagnosis at sea of these components is extremely difficult, it is oftentimes necessary to replace each of the possibly faulty components or the complete buoy relieved and replaced. With the present integrated lantern apparatus, the entire buoy lantern may be removed and replaced by one known to be operational.

Existing lantern gimbal systems, although not currently used to any appreciable extent, are rarely housed. Consequently, the gimbal bearings are vulnerable to corrosion by the marine environment. Additionally, existing gimbal systems for marine use are not sufficiently damped, permitting them to oscillate in rough seas and high winds causing damage to the lantern's lamps and lampchargers.

The present invention substantially overcomes the aforementiond disadvantages and provides an integrated buoy lantern device employing a heavily damped gimbal structure which supports the drum lens, flasher, lampcharger and batteries. The gimbal structure is designed to accommodate an angular heel to approximately 11° from the vertical. The present integrated buoy lantern device also includes a clear lens cover surrounding the drum lens, a solar panel disposed above the drum lens, and a clear dome covering the solar panel, each of which can readily be swung as a unit when access to the lantern's interior is desired.

DETAILED DESCRIPTION OF THE INVENTION

Figure 1:
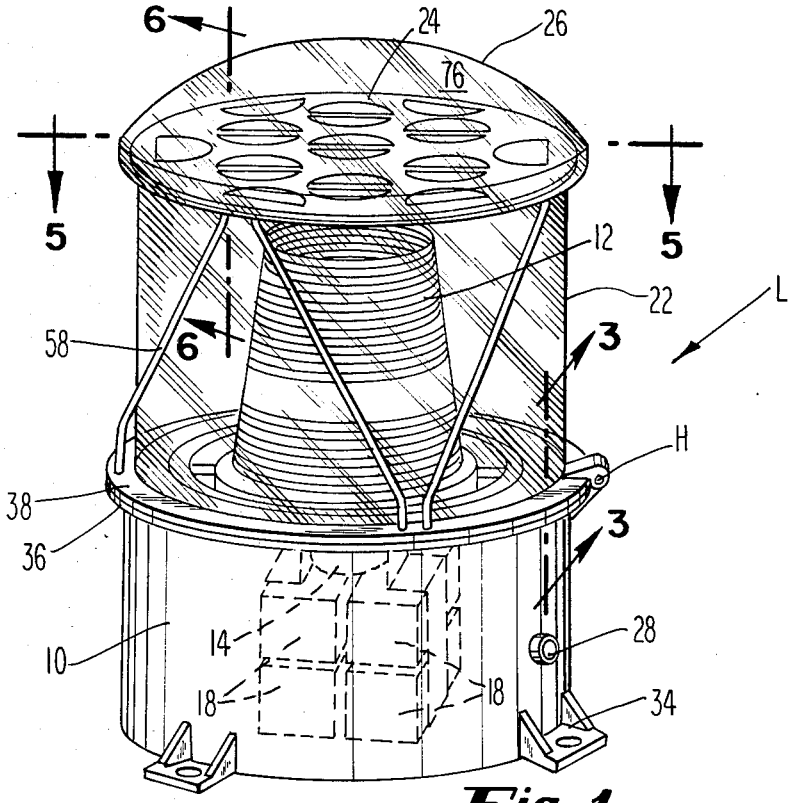
FIG. 1 is a perspective view, partially diagrammatic, of a typical embodiment of the buoy lantern device of the present invention, components omitted for purposes of clarity.
Figure 2:
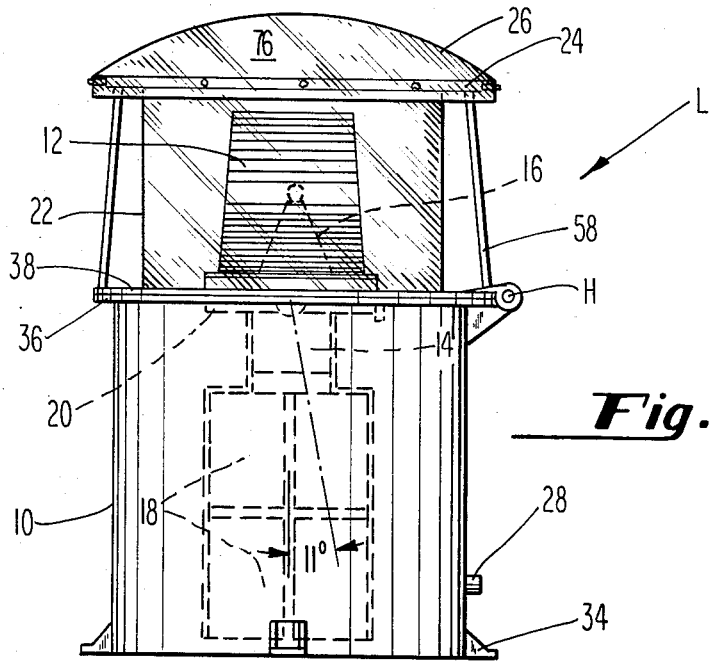
FIG. 2 is an elevational view, part in phantom, showing relative location of various components of the lantern of FIG. 1, parts omitted for clarity.

In FIGS. 1 and 2, the integrated buoy lantern device L of the present invention includes a housing 10, fresnel-type drum lens 12, flasher 14, lampchanger 16, and batteries 18, all but housing 10 supported on a gimbal structure 20. The device additionally comprises a clear lens cover 22 surrounding drum lens 12, solar panel 24 supported on lens cover 22, and a clear dome 26 covering solar panel 24 and supported thereon. Drum lens 12, lens cover 22 and dome 26 are conveniently acrylic, or other suitable clear plastic.

Flasher or timer 14 is conventional, may be purchased off-the-shelf, and is preferably solid state capable of complex flash up to five or more characters per period, including any Morse code letter or any number code. Specific flash characteristics desired by a customer may readily be designed into the flasher.

Daylight control or sun switch 28 is used with flasher 14 and is mounted exteriorly on housing 10. Daylight control 28 is a photocell control which permits the lantern to flash only when the intensity of the ambient light falls below a certain level.

Lampchanger 16 is a standard component of current battery-operated lanterns and may have four or six single contact, pre-focused lamps, operating on a dc voltage from battery or batteries 18. Lampchanger 16 is conventional and typically includs a a two-relay system, i.e., the coil of the series relay is wired in series with the lamps in service. The motor armature holds the motor relay open as long as the current grounds through the lamp filament. When the lamp filament burns out, the motor relay circuit closes to cause the lamp turret to rotate until a new lamp is in operating position.

The batteries are preferably rechargeable sealed type employing a gelled electrolyte with calcium grids and a low self-discharge rate.

Figure 3:
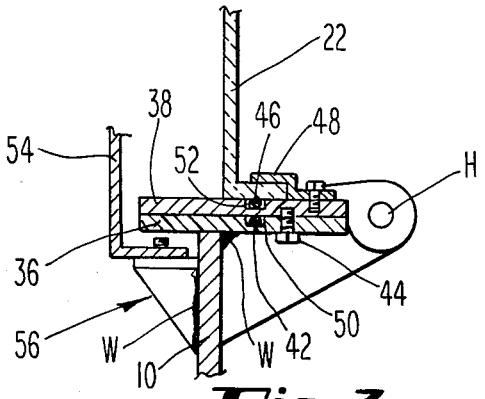
FIG. 3 is a sectional view of the lantern device of FIG. 1 taken substantially along line 3—3 thereof.

Housing 10 is provided at the lantern base portion with a plurality of bolt-down means 34 for securing lantern L to an upper surface of the buoy (not shown). Housing 10 is provided at its uppermost portion with a rim 36 welded thereto at W (FIGS. 3 and 4), which rim 36 mates with an upper rim 38. Rims 36 and 38, preferably aluminum, as is housing 10, are maintained in water tight relationship by means of O-ring 42 and retaining screws 44. Another O-ring 46 and a plurality of clamping means 48 insure water tightness between lens cover 22 and rim 38. O-rings 42 and 46 are disposed in annular recesses 50 and 52 of rims 36 and 38 respectively.

Angled support members 54 are threadedly mounted to vertical supports 56 suitably secured to housing 10 adjacent an upper portion thereof. Of course, support members 54 may be secured directly to housing 10. Angled support members 54 also support gimbal structure 20, later described.

Access to the interior of lantern L is effected by simply removing retaining screws 44 and pivoting the upper rim 37 on hinge H articulating between the rims. Upper rim 38 supports lens cover 22, solar panel 24, dome 26, and rods 58 interconnecting the solar panel with the upper rim.

Figure 5:
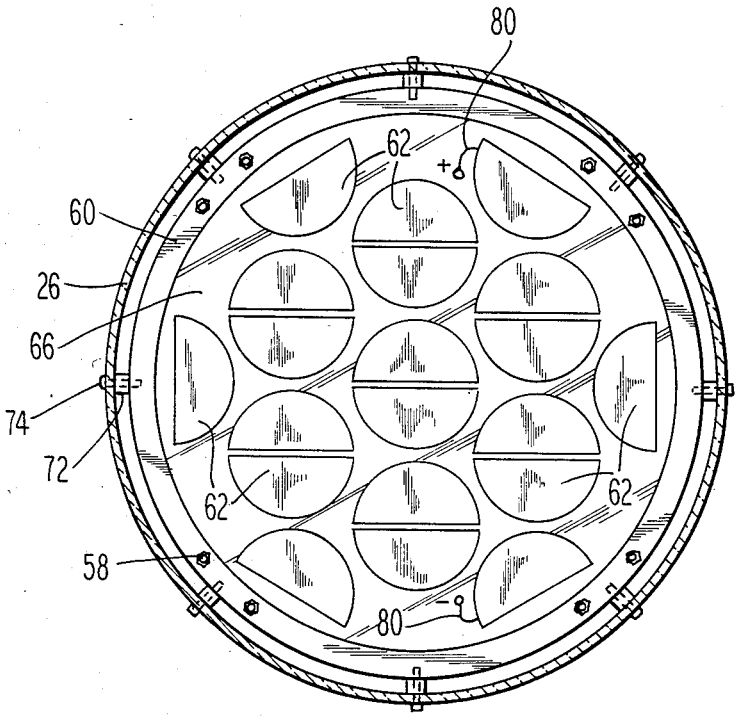
FIG. 5 is a sectional view of the lantern device of FIG. 1 taken along line 5—5 thereof, looking down on the solar panel.
Figure 6:
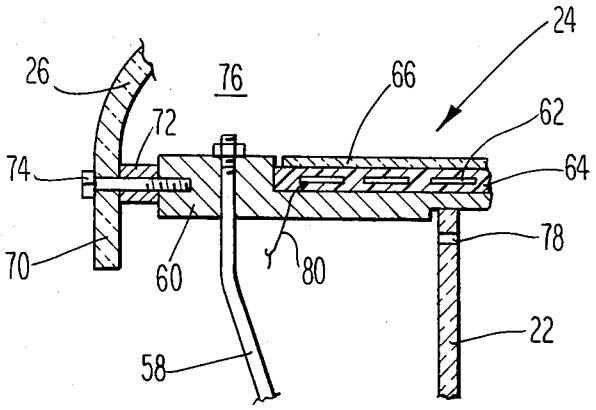
FIG. 6 is a sectional view of the lantern device of FIG. 1 taken substantially along line 6—6 thereof.

Solar panel 24 (FIGS. 5 and 6) includes a circular tray 60, suitably aluminum, which carries solar cells 62 suspended in a clear silicone potting compound 64. A clear glass cover plate 66 rests atop the potting compound.

Typically, solar panel 24 consists of 20 solar cells, each cell comprising a flat simicircular photovoltaic cell 62 of 4" diameter connected in series to produce one ampere at 7.4 charging volts with a solar intensity of 100 milliwatts/cm$^2$. Alternatively, the semicircular solar cells may be halved to provide 40 series-connected quarter cells to produced ½ ampere at 14.4 charging volts for a nominal 12 volt system with equivalent solar intensity.

Of course, the invention is not intended to be limited to the photovoltaic cell configuration above described. For example, it may be desirable to series connect 40 one-quarter 4" cells for use in a 12 volt system. Or the cells could be connected to provide a pair of parallel strings of 20 cells each for use in a 6 volt system with double the current, and so on.

Cells 62 are preferably silicon encapsulated in a clear silicone potting compound 64. Cover 66 is preferably glass or clear plastic sheet.

Aluminum tray 60, in addition to containing solar cells 62 therewithin, functions to conduct heat from the cells to prevent excessive heat from building up within potting compound 64. Tray 60 extends outwardly of cylindrical lens cover 22, and is maintained in spaced relationship to rim portion 70 of dome 26 by a plurality of spacers 72 secured therebetween by means of threaded bolts 74. Thus, ambient air is permitted to circulate within domed area 76 as well as below tray 60 resulting in the temperature of the solar cells 62 being maintained at safe temparature levels, i.e., below about 140° F. It is appreciated that the output voltage of solar cells falls with increasing temperature. Without adequate cooling, the temperature within domed area 76 could rise to excessively high temperatures, i.e., above 180° F. Although not shown, that portion of aluminum tray 60 disposed outwardly of lens cover 22 could be provided with fins to promote additional cooling.

Small vent holes 78 are provided at an upper portion of lens cover 22 to permit escape of any hydrogen which may have been generated during the battery charging cycle.

Insulated electrical leads 80 from solar cells 62 are conveniently fed through tray 60.

Gimbal 20 includes a square outer frame member 84 and a square inner frame member 86 symmetrically spaced therewithin (FIGS. 4 and 7), although round or other suitably shaped frames may be used advantageously. Outer frame 84 is supported on angled supports 54 as previously mentioned (FIG. 4).

Outer frame 84 is permitted to pivot with respect to angled support 54 by means fo a pair of aligned pivot shafts 92 (only 1 shown in FIG. 7) articulating therebetween. Outer frame 84 pivots around pivot shafts 92 in the directions indicated by arrows 94.

Inner frame 86 is supported by outer frame 84 by another pair of aligned pivot shafts 96 communicating therebetween, each pivot shaft 96 being centrally mounted between corresponding sides of frames 84 and 86. Inner frame 86 pivots around pivot shafts 96 in directions indicated by arrows 98, which directions are normal to the directions by rotation or movement of outer frame 84.

Figure 4:
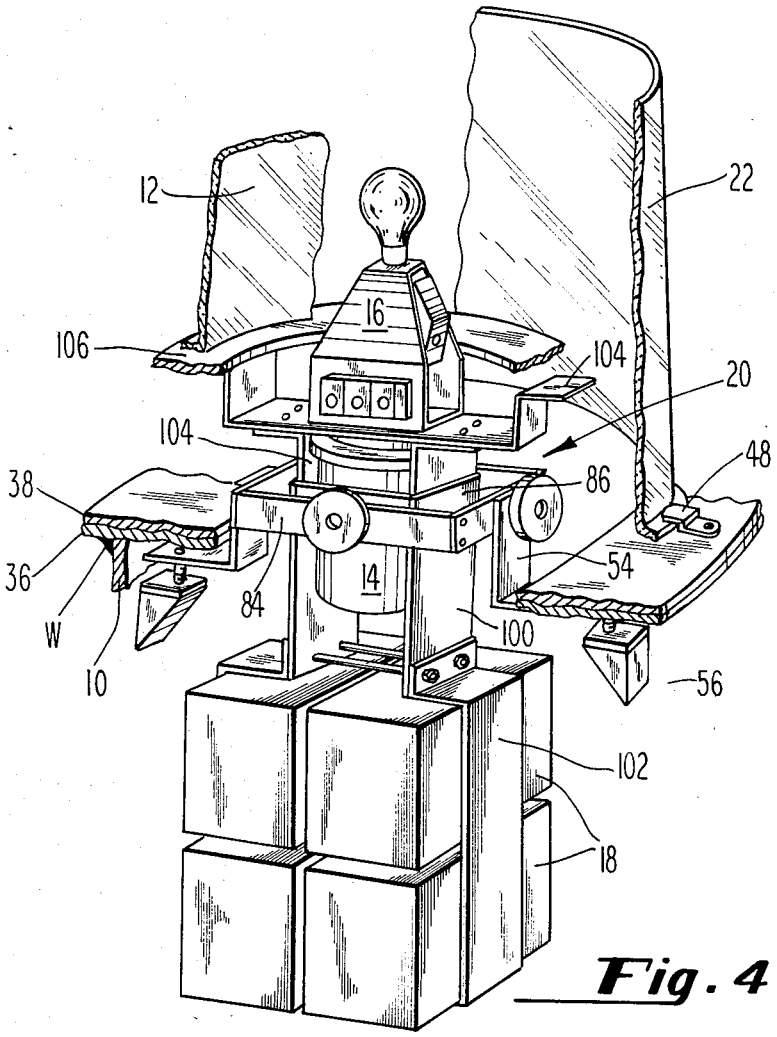
FIG. 4 is a fragmented perspective view, partially sectioned, partially cut away, of the lower portions of the present lantern device.

Inner frame 86 carries support assembly 100 (only 1 shown in FIG. 7) including battery support bars 102 (FIG. 4) depending from inner frame 86 for holding batteries 18, and a drum lens support mount 104 extending upwardly from inner frame 86 for mounting drum lens 12 directly thereon, or, as illustrated in FIG. 4, for mounting to an annulus 106, which, in turn, is suitably secured to the drum lens support mount 104.

As aforementiond, the present gimbal structure is capable of accommodating an angular heel of the buoy to approximately 11° from vertical (FIG. 2), i.e., when the buoy is tilting due to wind and/or current, and not for sporadic tilting due to individual wave motion, for example. Since most existing lighted buoys are provided with counterweights to thereby prevent heeling in excess of about 10°, the present gimbal structure will automatically maintain the drum lens in substantially vertical position. Because lens verticality is assured, the present lantern may also be used advantageously on fixed structures where narrow divergence lanterns are currently extensively employed but which require periodic leveling.

Figure 7:
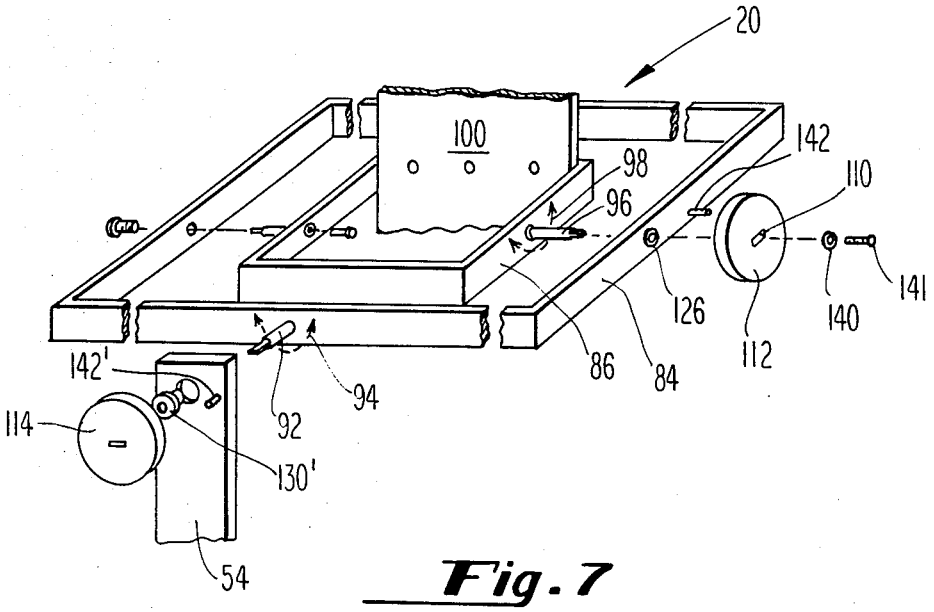
FIG. 7 is perspective view of the gimbal illustrated in FIG. 4.
Figure 8:
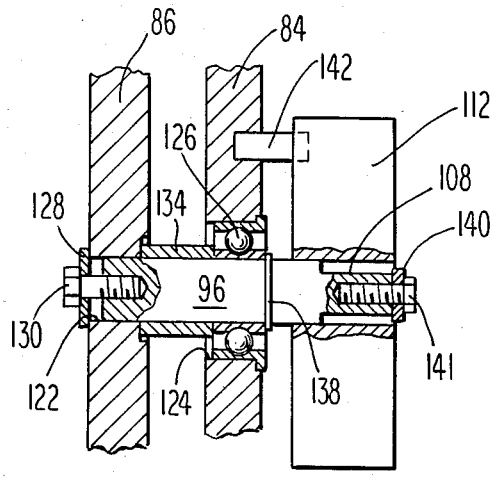
FIG. 8 is a vertical section of the gimbal of FIG. 7 taken through a pivot shaft with cooperating damping means.
Figure 9:
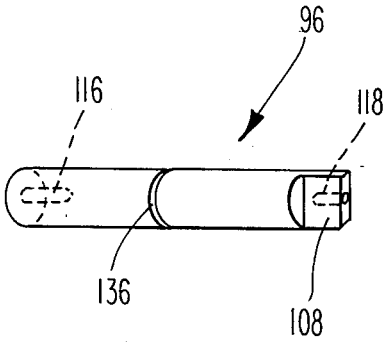
FIG. 9 is a perspective view of the pivot shaft of FIG. 8.

Referring now to FIGS. 7, 8 and 9, pivot shaft pairs 92 and 96 are identical. Pivot shaft 96, for example, includes a flat 108 at an outer portion which engages a rotatable centrally disposed slotted member 110 of a damper 112. Damper 112 may be purchases commercially, and typically, is filled with a viscous silicone fluid. A conventional paddle wheel (not shown) is rotatable within the silicone fluid, the paddle wheel, being integral with slotted member 110. Slotted member 110 is capable of continuous rotation in damper 112 in either direction of rotation to provide equal damping in either direction of rotation. Two dampers are required, i.e., damper 112 associated with inner frame to 86 and damper 114 associated with outer frame 84. Dampers 112 and 114 cooperate to provide heavy damping of the gimbal structure to sustained tilting of the buoy in any direction.

Each pivot shaft is provided with a threaded bore 116 at its inner end and a similar threaded bore 118 in flat 108 at its outer end.

Aligned, different diameter bores 122 and 124 in inner and outer frames 86 and 84 respectively receive pivot shaft 96 therein. Bore 124 is of larger diameter then bore 122 in order to receive bearing 126 therein.

A washer 128 cooperates with screw 130 engaging bore 116 of pivot shaft 96 to maintain each pivot shaft 96 secure to inner frame 86. Spacer 134 around pivot shaft 96 maintains desired spacing between frames 84 and 86. A recessed annulus 136 is provided in pivot shaft 96 intermediate its ends for receiving retaining ring 138 for preventing movement of bearing 126 along pivot shaft 96. Slotted member 110 of damper 112 is mounted to flat 108 by means of a washer 140 and screw 141 engaging threaded bore 118. A pin 142 protrudes outwardly from outer frame 84 for engagement with a detent (not shown) in damper 112 to prevent rotation thereof around pivot shaft 96. Thus, sustained tilting of the buoy in a direction, for example, paralleling the direction of alignment of the pivot shafts 92 will result in the drum lens remaining substantially vertically disposed by virtue of the present gimbal structure, damper, and bank of batteries suspended form the inner frame.

As abovementioned, batteries 18 are hung from inner frame 86. The center of gravity of the batteries is below the gimbal axis and thus when the buoy is inclined, the battery weight serves to provide the desired righting moment. The lens, lampchanger, and flasher, also supported on the inner frame, are comparatively light in weight.

If sustained tilting occurs in a direction, for example parallel with the alignment of pivot shafts 96, the outer frame 84 will remain substantially horizontal, for reasons discussed generally hereinabove, i.e., damper 114, and the weight of batteries 18 being transmitted centrally to the outer frame through pivot shafts 96. Of course, sustained tilting of the buoy in directions other than the two directions discussed above, will result in cooperative action of both frames 84 and 86 to maintain the drum lens 12 in substantially vertical posture.

Regarding movement of the outer frame, bearings 130' are disposed in supports 54, and pin 142' extends from one thereof to cooperate with damper 114.

Gimbal structure and support structure may conventiently be made of stainless steel.

A battery charge regulator can readily by installed, if desired, within housing 10. Cables would pass across gimbal bearings where movement is minimal.

From the foregoing description, it is apparent that an improved marine lantern has been provided which may readily be removed from the buoy for servicing and/or replacement. The solar panel of the lantern is protected from physical damage as well as fouling from birds by a clear dome cover. The solar panel needs no mounting hardware, and may be of minimal size since it is not shadowed by the lantern. The lantern's lens and batteries are supported on a heavily damped gimbal which responds to a sustained list caused by winds or current, but not to sporadic wave undulations. The lens is protected from adverse effects of water on its prisms, and no vented battery compartment in the buoy is required or external electrical cables. The clear dome cover additionally functions to isolate the lens and gimbal from wind forces which may urge the lantern from its desired vertical posture.

I claim:

1. Integrated and unitary lantern apparatus for mounting on a marine buoy and readily removable therefrom as a unit, said apparatus comprising, in combination, a lantern housing at a lower portion of said lantern apparatus.

components including a clear lens cover, a solar panel, and a clear dome, each of said components disposed above said housing in sequential order abovementioned and supported by said component immediately therebelow, a gimbal having an outer frame, and an inner frame supported therein by first pivot shafts communicating therebetween, said outer frame pivotally mounted to and supported by support means secured diametrically to said housing, said outer frame pivotally mounted to said support means on second pivot shafts, damping means associated with one each of said first and second pivot shafts, said inner frame and said outer frame pivotable substantially independently to each other and sustained tilting of said buoy, said outer frame pivotable in a direction normal to the direction of pivot of said inner frame, drum lens mounted on said inner frame thereabove, means for supplying light to said lens for transmission thereby, a bank of batteries suspended from said inner frame for providing a righting moment to said gimbal when said buoy is tilted or inclined for a sustained period by currents and/or wind, said lantern being devoid of counterweight means, said batteries providing electric power to said means for supplying light, transparent shielding means for protecting said lens and gimbal from a marine environment, said solar panel providing power to recharge said batteries, said solar panel having a circular tray for receiving said lens cover for support thereon, said tray containing solar cells for receiving radiation from the sun, said lens cover having a plurality of vent holes adjacent an upper portion thereof to permit escape of hydrogen gas therethrough when said batteries are charged by power generated by said solar cells of said solar panel, said support means for supporting said gimbal outer frame to said housing comprising support members mounted therebetween carrying a pair of mating annuli thereon hingedly separable from each other by hinge means articulating therebetween, said lens cover supported on upper of said mating annuli and pivotable on said hinge means to provide ready access to interior of said lantern apparatus while permitting said drum lens supported on said inner gimbal frame thereabove and said batteries suspended from said inner gimbal frame therebelow to remain substantially vertically disposed independently of such pivoting on said hinge means, said batteries suspended from said inner frame of said gimbal providing vertically to said lantern apparatus when said marine buoy is heeling up to above 11° from vertical due to wind and/or current, and bolt-down means articulating between said lantern housing and marine buoy permitting said lantern apparatus to be readily removed therefrom.

* * * * *